US005317328A

United States Patent [19]

Allen

[11] Patent Number: 5,317,328

[45] Date of Patent: May 31, 1994

[54] HORN REFLECTOR ANTENNA WITH ABSORBER LINED CONICAL FEED

[75] Inventor: Daniel C. Allen, Saco, Me.

[73] Assignee: Gabriel Electronics Incorporated, Scarborough, Me.

[21] Appl. No.: 596,100

[22] Filed: Apr. 2, 1984

[51] Int. Cl.[5] ..... H01Q 13/00

[52] U.S. Cl. ..... 343/786; 343/781 R

[58] Field of Search ..... 343/786, 840, 781 R, 343/912

[56] References Cited

U.S. PATENT DOCUMENTS 3,314,071 4/1967 Lader et al. ..... 343/840
4,349,827 9/1982 Bixler et al. ..... 343/786
4,410,892 10/1983 Knop et al. ..... 343/781 R

FOREIGN PATENT DOCUMENTS 305 1/1979 European Pat. Off. ..... 343/781 R

OTHER PUBLICATIONS

Dybdal, "Horn Antenna Sidelobe Reduction Using Absorber Tunnels", IEEE AP-S Int. Symposium, Stanford, Ca., Jun. 6, 1977.

*Primary Examiner*—Michael C. Wimer
*Attorney, Agent, or Firm*—Charles E. Pfund

[57] ABSTRACT

A conical horn microwave antenna has a reflector positioned at the large end of a conical feed horn which has the side walls of the horn wider than the projected effective area of the reflector such that microwave absorber material lining the feed horn does not obstruct wave propagation between the feed horn and the effective reflector area.

8 Claims, 2 Drawing Sheets

HORN REFLECTOR ANTENNA WITH ABSORBER LINED CONICAL FEED

BACKGROUND OF THE INVENTION

This invention relates generally to microwave antennas and is disclosed particularly as utilized in a horn reflector antenna of the type disclosed in Dawson, U.S. Pat. No. 3,550,142. Such antennas have been in use for many years as microwave links in long distance telephone transmission and other data link communication service. Such antennas take the form of a conical section which is coupled at its narrow end to a microwave horn to serve as a conductive shield and wave guide of expanding area to an open end of the conical section which is adjacent to a reflector inclined at an angle to reflect microwave energy to a from the open end of the conical section as the antenna is used for two-way transmission and reception. Such antennas usually employ a sector of a paraboloid as the reflector, the focus of the paraboloid being at the apex of the conical section and forming the feed source for the horn which is coupled to the narrow end of the conical section. With the paraboloid reflector oriented at 45° to the axis of the conical section, the antenna can be mounted with that axis vertical and have a horizontal aperture which is the size of the horizontal projection of the paraboloidal area.

In the prior art conical horn antennas have generally been in two forms, one in which the conical section is shaped with a rectangular cross-section and thus appears as an inverted, truncated pyramid with the paraboloidal reflector forming a roof over the wide end of the pyramid and the aperture being the opening from the top edge of the paraboloid to the top edge of the wall of the conical section. As such, the antenna forms a completely conductive enclosure except for the aperture opening which has been found to be advantageous both from the standpoint of emitting spurious radiation apart from the main beam and to avoid receiving unwanted incoming signals which are not on the main beam.

The Dawson patent referred to provides the modern configuration of the horn reflector antenna, and comprises as the physical enclosure a vertical right circular cone intersecting a horizontal right circular cylinder with a roof cap extending approximately 45° above the intersection of the axes of the cone and cylinder to complete the conductive enclosure. As before, the aperture remains open and in the Dawson type antenna is the open end of the horizontal right circular cylinder. Suspended beneath the roof cap at an angle of 45° is a paraboloidal sector reflector, the focus of the paraboloid being at the apex of the conical section and the horizontal projection of the paraboloid being the circular aperture at the open end of the right circular cylinder. This aperture is usually closed by a microwave transparent radome to permit the entire enclosure to be pressurized.

As mentioned in the Dawson patent, microwave absorber material has been used within the enclosure of such antenna for suppressing reflections. In the U.S. Pat. No. 3,936,837, to Coleman et al., the disclosure of lining the entire right circular cylinder with microwave absorber material is suggested and discloses the use of a corrugated conical feed for suppressing side lobe levels.

The U.S. Pat. No. 4,249,183, to Bui Hai, shows a parabolic dish antenna illuminating a planar reflector with a cylindrical wave guide between the antenna and reflector with the cylindrical wave guide lined with absorber material. European Patent Publication No. 0,000,305 discloses a horn fed reflector antenna with absorber material lining both the enclosing shield and the conical feed section.

The Assignee of the present application, Gabriel Electronics Incorporated of Scarborough, Me., has for many years sold the Dawson type antenna, with microwave absorber lining in both the circular cylinder and the conical section. In addition to suppressing unwanted reflections in the cylindrical portion of such antennas, microwave absorber linings have a marked effect on the side lobe pattern of such antennas. As the use of such antennas has increased and the placement of antennas operating on multi-microwave band assigned frequencies in close proximity to one another has occurred, the importance of side lobe levels has become more important, particularly the effort to reduce such side lobe levels to very low values relative to the main beam. As the efforts to achieve ever lower side lobe levels has continued, Gabriel has extended the absorber lining in the conical section progressively further down into narrower regions of the conical section. This expedient has reduced side lobe level and improved the overall radiation pattern envelope of such antennas, but as the microwave absorber has proceeded further down the conical section, its thickness relative to the diameter of the cone has become an important factor. As the thickness of microwave absorber (actually the double thickness, since the lining on opposite walls of the cone is involved) relative to the diameter of the conical section, the effective area of the paraboloidal reflector becomes shadowed by the presence of the microwave absorber, such that the gain of the antenna is reduced. Accordingly, the commercial antennas produced by Gabriel Electronics Incorporated in the past have been limited in the extent that microwave absorber could be extended further down into the narrow portion of the conical section by the consequent reduction in the gain of the antenna, as a design trade-off.

Recently a new commercial antenna has appeared on the market corresponding to the patent to Knop et al., U.S. Pat. No. 4,410,892. This Dawson type antenna has the extension of the cylindrical microwave absorber lining 22 a certain distance down into the conical section and then resorts to a different type of microwave absorber material 35 to extend the absorber lining further into the narrow diameter portions of the conical section, relying upon the thinness of the different absorber material 35 to avoid blocking or shadowing the reflector relative to the microwave source at the throat of the conical section.

SUMMARY OF THE PRESENT INVENTION

The present invention is based on the discovery that the conical feed horn of the Dawson type antenna can be enlarged without deleterious effect on the microwave performance on the combination to provide an unobstructed passage of microwave energy between the reflector and the source at the focus of the reflector located at the base of the conical section, thereby permitting a lining of substantial thickness to be placed on the inner wall of the expanded conical section without blocking or shadowing the microwave paraboloidal reflector. This combination thus achieves the full performance of the Dawson type antenna, particularly as respects the gain to be achieved with the design aperture of the paraboloidal reflector, while at the same time producing the improved side lobe performance in reducing low level side lobes as has been obtained by lining the conical section with microwave absorber. This latter feature can be pursued to the ultimate with the present invention since the microwave absorber can be placed on the inner wall of the conical section as far down as is required by appropriately designing the enlarged conical section to receive the optimum extension and type of microwave absorber material without blocking the transmission of energy in each direction through the conical section.

It is accordingly the object of the present invention to provide an improved horn reflector antenna having full aperture gain while reducing low level side lobes by the use of microwave absorber in the conical section of the antenna while minimizing blockage of the passage of microwave energy therethrough.

DETAILED DESCRIPTION

Figure 1:
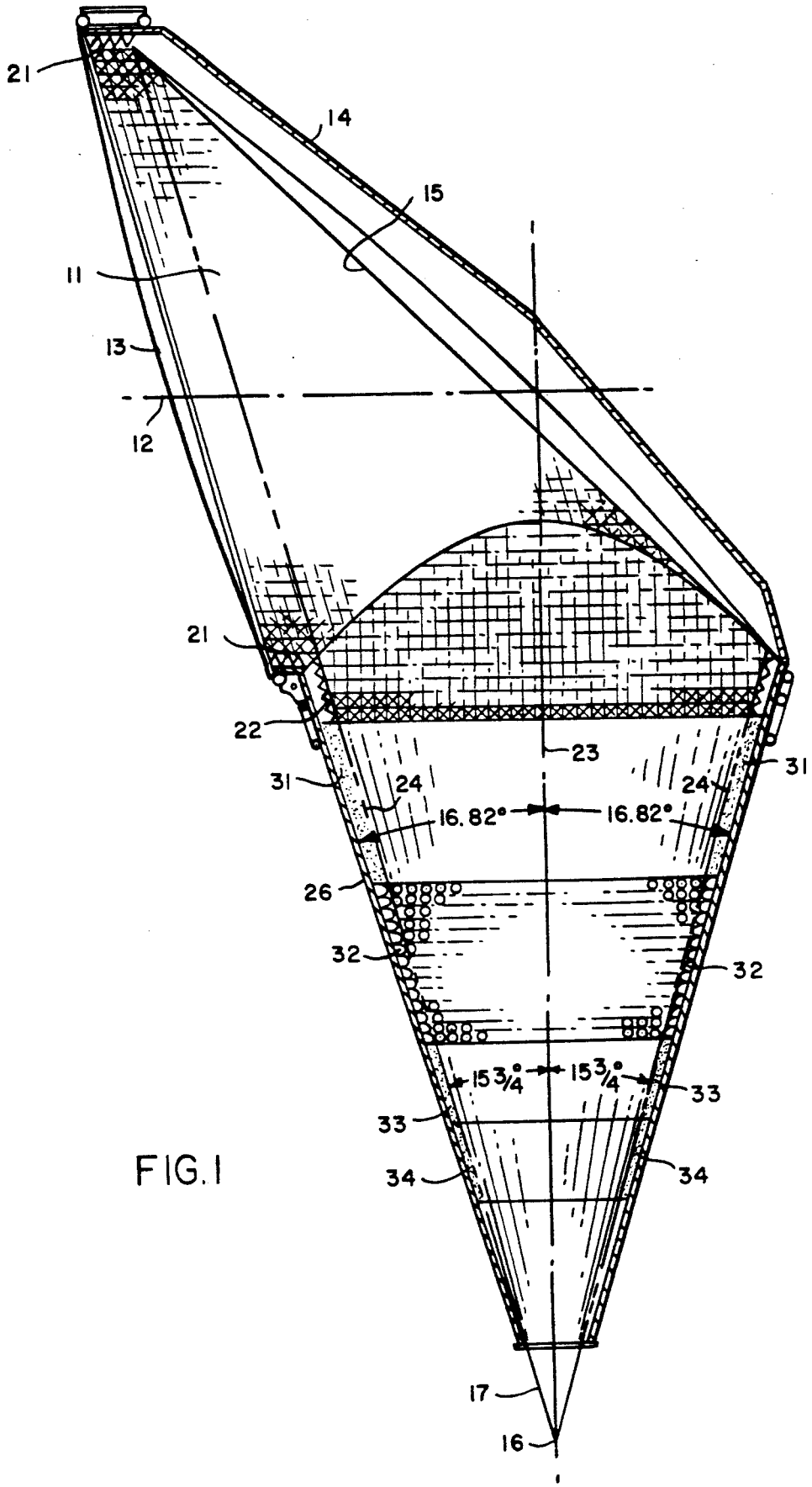
FIG. 1 is a sectional view of a preferred embodiment of the present invention.

FIG. 1 is a sectional view of a configuration of a horn reflector antenna having a right circular cylinder 11 having a horizontal axis 12 to provide a microwave transparent aperture covered by a transparent radome 13. The cylinder 11 is truncated approximately 45° and closed by a roof cap 14. Suspended beneath the roof cap 14 is an oval shaped parabolic reflector 15 which is a sector of a paraboloid having its focus at the point 16, where a suitable microwave feed coupling to a transition section and conical horn 17 provides for transmission and reception of microwave energy from any suitable source or receiver coupled to the microwave transition at the focus 16 as it is reflected from the mirror surface 15 and transmitted or received with the main beam axis along the axis 12 as the energy passes through the radome 13.

The aperture of the antenna is approximately the circular diameter of the cylinder 11 less twice the thickness of microwave absorber material 21 which lines the inner wall of the cylinder 11 and extends for a distance at 22 down into a conical section which will be hereinafter described. The size of the aperture generally corresponds to the projection of the area of reflector 15 along the axis 12. The projection of the effective area of the reflector 15 in the vertical direction along axis 23 to the focal point 16 is indicated by the construction lines 24. In prior art antennas of this type the energy which is transmitted and received by the conical horn 17 has been guided to illuminate the reflector 15 by a conductive conical section conforming to the flare angle indicated by construction lines 24 so as to guide the microwave energy to and from the effective area of the mirror surface 15.

In accordance with the present invention, the conical horn 17 launches and receives microwave energy from the mirror surface 15 with a taper corresponding to the construction lines 24, just as in the prior art. Applicants have found that the wave guide effect necessary for guiding the energy to and from the mirror surface 15 and for providing the necessary shielding can be accomplished by a conical section 26 which has a larger flare angle than the angle indicated by construction lines 24. Since a major portion of the power transmitted (and energy received) by the horn 17 is determined by its flare angle to be within the angle of construction lines 24 it is possible to line the space between construction lines 24 and the actual inner surface of the cone 26 with microwave absorber material without significantly impeding the flow of microwave energy in either direction, and thus not reducing the transmitting and receiving gain of the antenna as a whole. By lining the inner wall of the cone 26 with microwave absorber and without blocking the passage of energy, the improved side lobe patterns which had previously been obtained in the prior art only with consequent loss in gain, are achieved without such gain reduction in the antenna of the invention.

In the preferred embodiment shown, the microwave absorber material in the conical section 26 can employ the type best suited for the axial position of the absorber along the cone. Thus, at the top of the cone the absorber material 22 of the type used in the cylinder and shown as absorber 21 can be extended down into the cone, as previously stated. Next in the order descending into the narrow region of the cone comes a series of parallel sections 31, 32, 33, and 34. Each of these sections is lined with a different absorber material as follows:

| Section | Type of Absorber | Thickness (inches) |
|---|---|---|
| 22 | AAP-3P | 3" |
| 31 | ML-77 | 2¼" |
| 32 | AAP-1.5C | 1½" |
| 33 | ML-75 | 1⅛" |
| 34 | ML-74 | ¾" |

The invention, of course, is not limited to these particular absorber materials and thicknesses.

The typical flare angle for prior art horn reflector antennas is approximately 15° each side of center line. As shown in FIG. 1, applicants' projection lines 24 form an angle of 15¾° each side of the axis in the cone 26, and the conductive inner wall of the cone 26 forms an angle of 16.82° each side of the cone axis. With this construction for a horn having an approximately 10-foot aperture, the spacing between the conductive inner wall 26 and the projection lines 24 at the upper end of the cone is approximately 3 inches. An antenna of 114 inch effective aperture diameter constucted in accordance with the invention has a gain of approximately 44 dB at 6 GHz with a directional radiation pattern envelope with side lobes below 65 dB at approximately 20° from the main beam. The antenna operates over a wide range of frequencies and is useful with this improved performance at the commercial bands of 4, 6 and 11 giga-Hertz.

Figure 2:
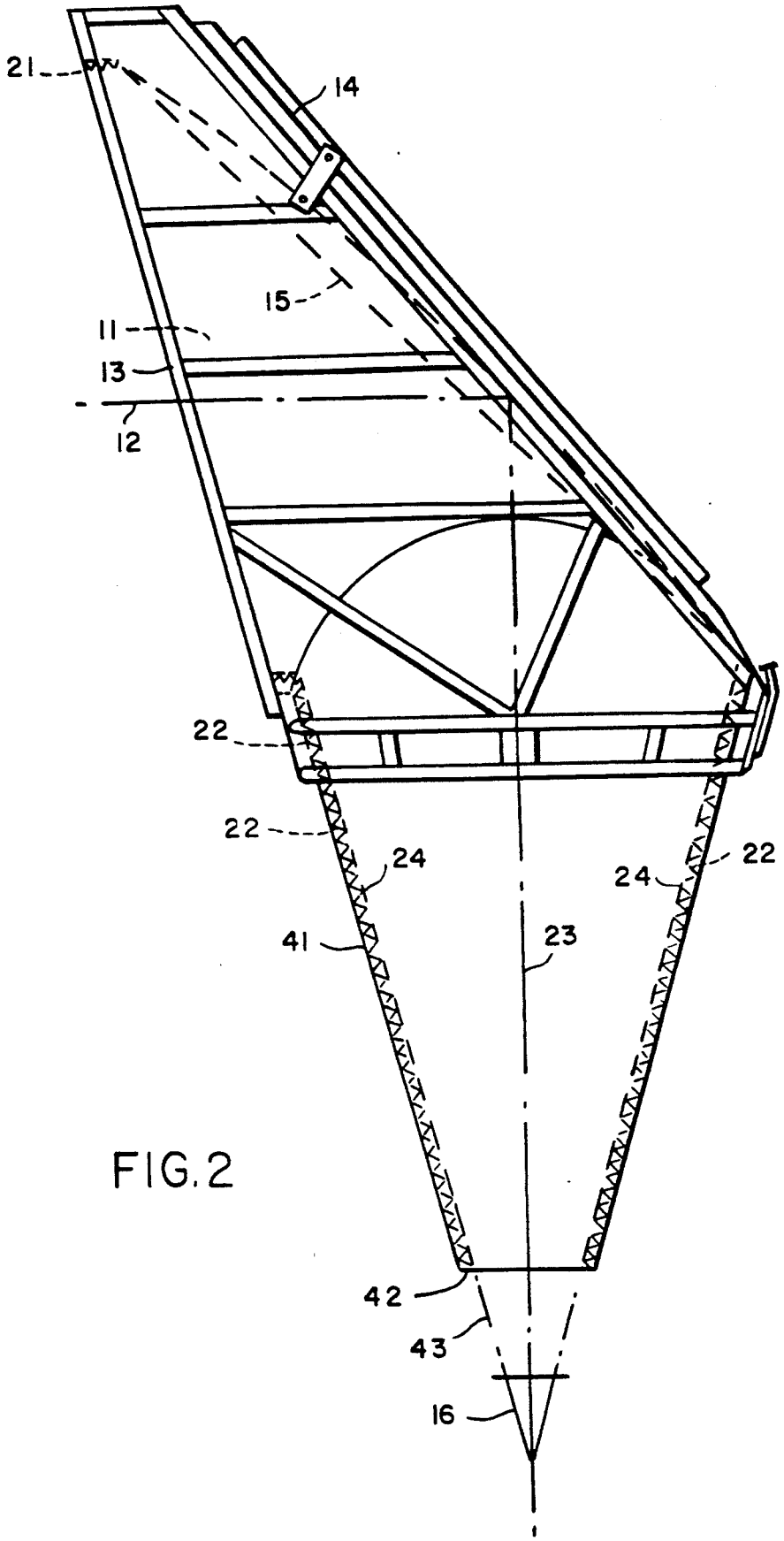
FIG. 2 is a side elevation view of an alternative embodiment.

Referring now to FIG. 2, an alternate form of construction of the improved horn reflector antenna is shown. The construction of this version of the invention will be described without further comment regarding the components described for FIG. 1, which have the same reference numerals in FIG. 2.

In FIG. 2, instead of having a tapered conductive conical section 26, as shown in FIG. 1, which is wider than the projection lines 24, a conductive cone having the same taper as the construction lines 24 but of larger diameter at each vertical position is provided. This larger cone 41 is closed at its base by a ring 42 to connect to a conical extension 43 of the feed horn 16. The feed horn 16, the extension 43, the ring 42 and t larger conical section 41 are all conductive and preferably of metallic construction to provide the pressure tight and electric signal shielding properties of a complete enclosure. As before the cone 41 intersects with the cylinder 11 and is welded along the line of intersection to provide together with the top cap 14 and the radome 13 for a closed and pressurized enclosure.

With the larger cone 41 uniformly spaced from the projection lines 24 a uniform space therebetween can be filled with any desired microwave absorber material, and as is shown the pyramidal type absorber material 22 is extended down the cone 41 to the bottom near the ring 42. Thus the microwave energy can pass actually through the cone 41 without shadowing the effective surface of the reflector 15, and at the same time the microwave absorber 24 along the length of the cone can operate to improve and reduce the side lobe levels.

The various structural details including the external support members shown in FIG. 2 are not described in detail since the construction of this basic form of the Dawson type horn reflector antenna is well known and need not be further described to those skilled in the art.

The invention is intended to include various modifications of the conductive metal cone section and horn reflector antenna with the accompanying provision for space for microwave absorber and its application to this inner wall without substantial obstruction of the propagation of microwave signals axially through the cone. Accordingly, the invention is to be limited only by the scope of the appended claims.

I claim:

1. In a horn reflector antenna which has a housing formed by a cone and a shroud the axes of which intersect at approximately 90°, the axis of said shroud being the radiation pattern beam axis of the antenna and the axis of said cone being the feed axis, and a reflector positioned within said housing at an angle to the beam axis and the feed axis to reflect microwave energy between an aperture on the beam axis and an off-set feed horn at the apex of said cone wherein said aperture is the open end of said shroud and approximately the size of the full area of said reflector projected on said beam axis, said cone extending from the mouth of said feed horn to intersect said shroud to form a conductive housing closed except for said aperture, the improvement which comprises making the inner diameter of said cone larger through out its axial length than the projected full area of said reflector to the mouth of said feed horn; and microwave absorber material lining the inner wall of said cone over substantially its entire length from said feed horn to said shroud, said material having thickness at any point in the cone no greater than the spacing between said inner diameter and the periphery of the projected full area of said reflector to said mouth to avoid blocking microwave energy, passing between said feed horn and the full area of said reflector, said absorber improving the radiation pattern by its effect on the microwave energy passing through the cone without significant gain loss due to absence of absorber in the path of said energy.

2. The antenna according to claim 1 in which said inner diameter is spaced a fixed distance from the periphery of the projected area of said reflector along said feed axis.

3. The antenna according to claim 2 in which said absorber material is a uniform layer having a thickness approximately equal to said fixed distance.

4. The antenna according to claim 1 in which said inner diameter is tapered at a greater angle than the projection of the periphery of said reflector to said mouth thereby progressively increasing said spacing from the narrow end of said cone toward said reflector.

5. The antenna according to claim 4 in which said absorber material has progressively increased thickness corresponding approximately with said increasing spacing.

6. In a horn reflector antenna in which a conductive housing is formed by a cone and cylinder intersecting with their axes at approximately 90° for enclosing a parabolic reflector that is located at the intersection of said axes and inclined at approximately 45° thereto to provide an effective area that reflects microwave energy between an aperture on the axis of said cylinder and the focus of said paraboloid on the axis of said cone, the size of said aperture being the projected effective area of said reflector on the axis of said cylinder, the improvement which comprises:

forming the inner wall of said cone to lie outside the lines of projection from said focus to said effective area of said reflector and lining said inner wall with microwave absorber material having thickness which substantially avoids blocking the microwave energy passing through said cone between said focus and said effective area of said reflector.

7. The antenna according to claim 6 wherein said microwave absorber material comprises a plurality of bands of absorber progressively increasing in thickness to approximately fill the volumn between said inner wall and said lines of projection.

8. A horn reflector antenna comprising:

a paraboloidal reflector forming a paraboloidal reflecting surface for transmitting and receiving microwave energy;

a horizontal conductive cylinder with means for mounting said reflector at approximately 45° to the axis of said cylinder, the open end of said cylinder forming the aperture of said antenna;

a conical conductive feed horn, extending from approximately the focus of said paraboloidal reflecting surface to an intersection with said cylinder for guiding microwave energy to said reflector;

a lower end portion of the inside surface of said conical horn being formed by a smooth metal wall above which the diameter of said conical horn is wider than necessary to illuminate the full area of said reflector with energy from said focus;

a lining of microwave absorber material completely lining said conical feed horn from the upper edge of said lower end portion to said intersection with said cylinder, the thickness of said absorber being selected to recess the absorber from the path of energy passing between the full area of said reflector and said focus to reduce the gain loss which is otherwise produced by absorber in said path while improving the radiation pattern by the operation of the absorber lining on energy transmitted through the conical horn.

* * * * *